US008006622B2

(12) United States Patent
Munoz Saldarriaga et al.

(10) Patent No.: US 8,006,622 B2
(45) Date of Patent: Aug. 30, 2011

(54) PROTECTOR FOR DETONATOR, AND METHOD OF USE

(75) Inventors: Daniel Ricardo Munoz Saldarriaga, Blainville (CA); Bruce Allen Underwood, Montreal (CA)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 941 days.

(21) Appl. No.: 11/873,815

(22) Filed: Oct. 17, 2007

(65) Prior Publication Data

US 2008/0083342 A1 Apr. 10, 2008

Related U.S. Application Data

(60) Provisional application No. 60/864,648, filed on Nov. 7, 2006.

(51) Int. Cl.
*F41A 9/00* (2006.01)

(52) U.S. Cl. ..... 102/481; 102/314; 102/331; 86/50; 206/3

(58) Field of Classification Search ..... 102/314, 102/322, 331; 86/1.1, 50; 206/3
See application file for complete search history.

(56) References Cited

U.S. PATENT DOCUMENTS

| | | | | |
|---|---|---|---|---|
| 2,721,652 | A | 10/1955 | Lyon | |
| 3,206,015 | A | 9/1965 | Zimmer et al. | |
| 3,739,724 | A | 6/1973 | Tlam | |
| 3,757,933 | A * | 9/1973 | Banta | 206/3 |
| 3,831,522 | A | 8/1974 | Romney | |
| 3,878,786 | A | 4/1975 | Ridgeway | |
| 4,023,494 | A | 5/1977 | Barton et al. | |
| 4,055,247 | A | 10/1977 | Benedick et al. | |
| 4,222,484 | A | 9/1980 | Howe | |
| 4,284,196 | A | 8/1981 | Lagerkvist | |
| 4,286,708 | A | 9/1981 | Porzel | |
| 4,310,444 | A | 1/1982 | Hamada et al. | |
| 4,347,929 | A | 9/1982 | Poe et al. | |
| 4,366,278 | A | 12/1982 | Hamada et al. | |
| 4,432,285 | A | 2/1984 | Boyars et al. | |
| 4,440,296 | A | 4/1984 | Howe et al. | |
| 4,678,827 | A | 7/1987 | Itoh et al. | |
| 4,768,418 | A | 9/1988 | Blommer et al. | |
| 4,821,646 | A | 4/1989 | True et al. | |
| 4,833,967 | A | 5/1989 | Kornhauser | |
| 4,979,632 | A | 12/1990 | Lee | |
| 5,097,945 | A | 3/1992 | Brooks | |
| 5,133,258 | A | 7/1992 | Rock et al. | |
| 5,160,468 | A | 11/1992 | Halsey et al. | |
| 5,248,055 | A | 9/1993 | Sanai et al. | |
| 5,293,821 | A | 3/1994 | True et al. | |
| 5,390,580 | A | 2/1995 | Gibbons, Jr. et al. | |
| 5,494,152 | A | 2/1996 | Sobczak et al. | |
| 5,501,151 | A | 3/1996 | Thureson et al. | |
| 5,585,591 | A * | 12/1996 | Waldock | 102/202.12 |
| 5,596,164 | A * | 1/1997 | Waldock | 102/202.9 |

(Continued)

FOREIGN PATENT DOCUMENTS

| | | |
|---|---|---|
| CA | 1052578 | 4/1979 |

(Continued)

*Primary Examiner* — Bret Hayes
*Assistant Examiner* — Michael D David

(57) ABSTRACT

Detonators comprising a base charge of explosive material present a safety hazard for transportation and storage, especially when a plurality of detonators are packaged together. Disclosed herein are detonator protectors for the explosive ends of detonators that, at least in preferred forms, prevent ejection of shrapnel and/or explosive energy upon detonator actuation. Also disclosed are corresponding detonator assemblies, packages comprising protected detonators or detonator assemblies, and corresponding packaging methods.

2 Claims, 4 Drawing Sheets

U.S. PATENT DOCUMENTS

| | | | | |
|---|---|---|---|---|
| 5,631,440 | A | 5/1997 | Thureson et al. | |
| 5,833,782 | A | 11/1998 | Crane et al. | |
| 5,873,455 | A | 2/1999 | Capers, III | |
| 5,996,777 | A | 12/1999 | Capers, III | |
| 6,196,107 | B1 | 3/2001 | Hoffman et al. | |
| 6,341,708 | B1 | 1/2002 | Palley et al. | |
| 6,347,700 | B1 | 2/2002 | Redfield et al. | |
| 6,454,085 | B1 | 9/2002 | Barker | |
| 6,629,597 | B2 | 10/2003 | Barker | |
| 6,699,563 | B1 | 3/2004 | Alhamad | |
| 6,865,977 | B1 | 3/2005 | Kim et al. | |
| 6,991,124 | B1 | 1/2006 | Palley et al. | |
| 7,066,320 | B2 | 6/2006 | Sansolo | |
| 7,546,917 | B1 * | 6/2009 | Lam et al. | 206/3 |
| 7,752,975 | B1 * | 7/2010 | Yousef et al. | 102/481 |
| 2002/0134054 | A1 | 9/2002 | Barker | |
| 2005/0016409 | A1 | 1/2005 | Husk et al. | |
| 2005/0150781 | A1 | 7/2005 | Barton et al. | |
| 2005/0188825 | A1 | 9/2005 | Sharpe et al. | |
| 2005/0242093 | A1 | 11/2005 | Sharpe et al. | |

FOREIGN PATENT DOCUMENTS

| | | | |
|---|---|---|---|
| CA | 2118528 | A1 | 4/1995 |
| CA | 2139799 | A1 | 7/1995 |
| EP | 0 013 473 | B1 | 12/1986 |
| WO | WO 95/19539 | A1 | 7/1995 |
| WO | WO 97/16697 | A1 | 5/1997 |

* cited by examiner

PROTECTOR FOR DETONATOR, AND METHOD OF USE

CROSS-REFERENCE TO RELATED APPLICATION

This application claims the priority right of prior U.S. patent application 60/864,648 filed Nov. 7, 2006 by applicants herein.

BACKGROUND TO THE INVENTION

Dangerous goods include liquid or solid substances, and articles containing them, that have been classified according to internationally-agreed criteria, and found to be potentially dangerous (hazardous) during transportation and/or storage. Most countries base their legislative requirements for storage and transportation of dangerous goods on the "*Recommendations on the transport of dangerous goods*" issued by the United Nations and the United Nations' prescribed testing codes for establishing the acceptability of various packaging and transportation methods.

Dangerous goods are assigned to different Classes depending on their predominant hazard, and on the basis of the specific chemical characteristics posing the risk. Such Classes include the following: class 1, explosives; class 2, gases; class 3, flammable liquids; class 4, flammable solids; class 5, oxidizing materials and organic peroxides; class 6, toxic and infectious substances; class 7, radioactive materials; class 8, corrosives substances; and class 9, miscellaneous (including asbestos, dry ice, engines, etc.). Except for very small packages, all packages and containers, shipping containers, unit loads, tankers, etc. which hold dangerous goods for transport must carry the correct Class Label. This label shows the nature of the hazard by the colour and symbol, and the Class of the goods by numeral. The Recommendations specify how storage areas are to be designed, constructed and located to minimize risks. The Recommendations are designed to assist the authorities and other emergency services, and to ensure that they have enough information to deal with incidents.

According to the United Nations classification system, explosives are also assigned compatibility group letters to facilitate their segregation during transportation. The letters used range from A-S, except for the letters I, M, O, P, Q and R. Also, they are sub-classified using the following subclasses: 1.1 for explosives with a mass explosion hazard; 1.2 for explosives with a severe projection hazard; 1.3 is for explosives with a fire, blast or projection hazard but not a mass explosion hazard; 1.4 stands for minor fire or projection hazard (includes ammunition and most consumer fireworks); 1.5 is for an insensitive substance with a mass explosion hazard; and 1.6 for extremely insensitive articles. In the explosives industry, it is preferred to attempt to package some explosives such as detonators in such a way as to reduce their hazard classification from 1.1 to 1.4, so that the explosive substances as packed represent only a minor fire or projection hazard. This provides far greater levels of safety and allows for much cheaper transportation costs. In the case of detonator packaging, this certification relies on the fact that they are packed and designed so as to confine most of the effects of any accidental explosion or ignition within the package itself, and if there are multiple devices, one detonator exploding will not lead to mass detonation of the others in the package.

In order for detonators to be certified as 1.4, they must pass the UN Test Series 6 external fire test (Bonfire test), which may include Tests 6(a), 6(b), 6(c), and 6(d). The packaging can have a significant influence on the explosive effects of substances and articles. The type of packaging can change the response of packed explosives or explosive articles in Test Series 6. One and the same explosive substance or article can therefore be assigned to different hazard groups, or even be rejected from Class 1 for transport depending upon the packaging used. The Bonfire test is performed on packages of explosive substances or explosive articles, or unpackaged explosive articles, to determine whether there is a risk of mass explosion or a potential hazard from dangerous projectiles, radiant heat and/or violent burning or any other dangerous effects. Typically, a stack of test substances or articles is placed on a non-combustible surface (steel grate) above a lattice of dried wood soaked with diesel fuel or equivalent source. A wire basket or clamps may be used to hold the articles in place. Sufficient fuel is used to provide a 30-minute fire. Three aluminum witness plates, each having a surface area of 4 $m^2$ (2 m×2 m), are placed away from the edge of the packages at a distance of four meters. The fire is ignited and the material is observed for:

a) Evidence of detonation, deflagration or explosion of the total contents;

b) Potentially hazardous fragmentation; and c) Thermal effects (i.e. size of the fireball, etc.).

The results are used to determine whether a reaction from an explosive article in its package, which was accidentally fired or initiated, would propagate to other articles or parts of the process. The package product is assigned a 1.4 certification if it meets the following requirements:

1) no indentations of the witness plates are observed; and 2) no projection, thermal effect or blast effect is observed.

With respect to the transportation and storage of detonators, the relevant criteria are generally accepted to be the UN 1.4 Code of testing. This certification relies upon the fact that when detonators are packed together for storage and/or transportation, inadvertent initiation of one detonator will not lead to mass detonation of other detonators present. This is especially important for air transportation since it is the most restricted mode of shipping. For such transportation, the 1.4S classification is required, the "S" being indicative that any hazardous effects arising from accidental functioning of the detonators in a package is confined within the package (unless the package has been degraded by fire, in which case all blast or projection effects are limited to the extent that they do not significantly hinder or prohibit fire fighting or other emergency response efforts in the immediate vicinity of the package).

Previously, packaging methods for the storage and transport of shelled detonators have included the use of protectors on the detonators or specially designed transportation boxes. For example, International Patent Publication WO95/19539 published Jul. 20, 1995, discloses a protector for use in the transportation and storage of detonators, comprising a detonator holder which is open at one end for insertion of a detonator, and closed at the other end, and which radially encloses the base charge of said detonator, at least one detonator retaining means integral with the detonator holder, and a first wall which is radially spaced around the holder and wherein the holder and wall define a space. In use, the detonator retaining means holds the detonator within the holder such that a free volume is provided around the base charge of the detonator.

Another example is U.S. Pat. No. 5,133,258 issued Jul. 28, 1992, which discloses a safe transportation holder and package for explosive devices such as blasting caps. Each cap is contained in an internal cavity in a holder, and surrounded by radially-spaced, elastomeric walls. The holders are arrayed in a container, and absorb the energy released by accidental detonation of one cap to prevent sympathetic detonation of others in the packages.

U.S. Pat. No. 6,454,085 issued Sep. 24, 2002 discloses a system and method for packaging shaped charges for transportation. Each shaped charge includes a housing and a liner having a high explosive disposed therebetween. A jet spoiler is positioned proximate the liner of each of the shaped charges to prevent the formation of a jet in the event of an inadvertent initiation of a shaped charge. The shaped charges are then oriented in first and second layers such that the jet spoilers positioned proximate the liners of the shaped charges in the first and second layers oppose one another. A shielding panel is disposed between the shaped charges of the first and second layers. The shaped charges including the jet spoilers and the shielding panel are placed within an expandable bag which is in turn enclosed within a transportation container. The jet spoilers may be constructed of a suitably dense material such as wood, plastic, foam, rubber, plaster, cement and the like. Ideally the material would be one that is environmentally friendly for easy disposal, lightweight to facilitate shipping and handling and economical. For example, biodegradable cardboard, balsa wood or compressed sawdust are suitable materials. The expandable bag is preferably made from a ballistic cloth, and the container may preferably be a corrugated cardboard box or a wood box.

U.S. Pat. No. 6,629,597, issued Oct. 7, 2003, discloses a system and method for packaging shaped charges for transportation. Each shaped charge includes a housing and a liner having a high explosive disposed therebetween. A jet spoiler is positioned proximate the liner of each of the shaped charges to prevent the formation of a jet of shrapnel in the event of an inadvertent initiation of a shaped charge. The jet spoilers may be comprised of a metal or non-metal material. Wood, plastic, rubber, plaster, cement, cardboard, balsa wood, or compressed sawdust are disclosed as particularly suitable attenuator materials for the jet spoilers. The shaped charges are then oriented in first and second layers such that the jet spoilers positioned proximate the liners of the shaped charges in the first and second layers are opposite one another. A shielding panel is disposed between the shaped charges of the first and second layers. The shaped charges, including the jet spoilers and the shielding panel, are placed within an expandable bag which is in turn enclosed within a transportation container.

As a further example, U.S. Pat. No. 4,286,708 discloses a package wherein the sympathetic or chain reaction detonation of stacked munitions is prevented by confining any random explosion essentially to a single explosive unit or container. Frangible inhibitor plates are located between adjacent munitions, such as artillery shells, so as to isolate the adjacent explosive units from a residual shock wave or case fragment that would otherwise trigger sympathetic detonation. The inhibitor plates may be constructed as part of a container in which an artillery shell may be stored, or the plates may be separately inserted between any adjacent warhead in any conventional storage pallet or transporting configuration. The plates are designed to absorb only that amount of explosive energy required to prevent sympathetic detonation, without requiring that the explosive forces be redirected away from adjacent shells, thus reducing the problem of redirected blast.

Other packaging methods involve wrapping a detonator in its down-hole wire, and caging a box of detonators within its cardboard box. For example, Canadian Patent application 2,118,528 discloses a non electric detonator assembly for its safe transport in bulk wherein a detonator is located substantially along the axis of a coil of initiation tubing, the initiation tubing being wound such that it may be unwound by drawing from the centre of the coil.

Another method used for packaging explosive devices such as detonators is one inspired by the military industry. It involves the use of a cardboard tube having a clay plug or equivalent thereof at one end. Such equivalents to a clay plug may include, but are not limited to, a plug comprising wood, compressed sawdust, cement, granulated sand, plaster, dry wall materials, and other materials. The device is enclosed in the tube, with its explosive end at or near the clay plug end. The plug acts, at least in certain circumstances, as a jet spoiler to absorb shrapnel from an explosion, and the tube functions as a flame retardant. The tube is preferably made of cardboard because this material is not too dense, inexpensive and environmentally benign. Examples of this packaging method can be found in United States Patent Applications published as 2005/0150781 and 2006/0108237 on Jul. 14, 2005 and May 25, 2006 respectively. US 2005/0150781 discloses a detonator protector including a housing fitted with an end cap at one end and a plug at the other end. US 2006/0108237 discloses a tubing assembly having opposed ends and a thick wall of relatively low-density fibrous material, and having an impact absorbing element positioned at each end of the tube.

Although numerous methods for the storage and transport of dangerous goods have been developed, there remains a continuing need to develop improved methods to increase security and safety of dangerous goods, and in particular explosive devices such as detonators. Moreover, there remains a continuing need to develop packaging methods for storage and transportation of detonators, with improved protection against inadvertent mass initiation of other detonators within a package.

SUMMARY OF THE INVENTION

It is an object of the present invention, at least in preferred embodiments, to improve the safety of transportation and/or storage of detonators.

It is another object of the present invention, at least in preferred embodiments, to provide a protector for use in transportation and/or storage of detonators It is another object of the present invention, at least in preferred embodiments, to provide methods for packaging a plurality of detonators.

Certain exemplary embodiments provide an assembly comprising:

(a) a detonator comprising a detonator shell, and an explosive end comprising a base charge of explosive material;

(b) a detonator protector comprising a recess for receiving and covering at least the explosive end of the detonator shell to contain shrapnel and/or explosive energy derived from the detonator in the event of inadvertent actuation of the base charge, said detonator protector being dimensioned such that a most of the detonator shell is not covered by the protector, thereby to allow the explosive material of said base charge to deflagrate in the event of inadvertent actuation of the detonator and/or exposure of the assembly to the heat of a fire.

Certain exemplary embodiments provide a detonator protector for covering at least an explosive end of a detonator, to contain shrapnel and/or explosive energy derived from the explosive end in the event of inadvertent actuation of a base charge contained within the explosive end, said detonator protector being dimensioned such that in use most of the detonator shell is not covered by the protector, thereby to allow the explosive material of said base charge to deflagrate in the event of inadvertent actuation of the detonator and/or upon exposure of said detonator and detonator protector to the heat of a fire.

Certain exemplary embodiments provide a method of protecting a detonator from emitting shrapnel and/or explosive energy during transportation and/or storage, the method comprising the step of: applying to an explosive end of the detonator, a detonator protector as disclosed herein.

Certain exemplary embodiments provide a method of packaging a plurality of detonators each comprising a detonator shell and an explosive end comprising a base charge, the method comprising the steps of: applying to each explosive end a detonator protector as disclosed herein, thereby to form protected detonators; and placing the protected detonators into a container.

BRIEF DESCRIPTION OF THE DRAWINGS

FIG. 3*e* is a side, perspective view of stacked rows of assemblies

DEFINITIONS

Figure 1A:
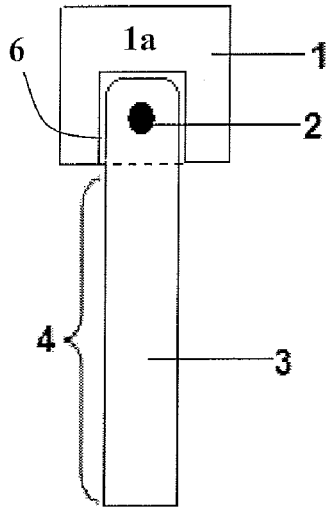
FIG. 1*a* is a sectional view of an assembly of the present invention.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: any device that is capable of being in signal communication with electronic detonators, for example to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device to collect detonator information and transfer the information to the blasting machine.

Central command station: refers to any device that transmits signals via radio-transmission or by direct connection, to one or more blasting machines. The transmitted signals may be encoded, or encrypted. Typically, the central blasting station permits radio communication with multiple blasting machines from a location remote from the blast site.

Explosive end: refers to a portion of a detonator where a base charge is located within the detonator, generally at an end opposite an end of a detonator that receives a signal transmission line or other means for receiving signals from an external source. Actuation of the base charge upon receipt by the detonator of a command signal to FIRE, optionally following count-down of a delay time, causes a release of explosive energy at or about the explosive end. As discussed herein, the base charge may also be accidentally or inadvertently actuated when a physical shock or unwanted electrical current is applied to the detonator, for example during transportation and storage.

Preferably: identifies preferred features of the invention. Unless otherwise specified, the term preferably refers to preferred features of the broadest embodiments of the invention, as defined for example by the independent claims, and other embodiments disclosed herein.

Flame retardant/flame retardant additive: refers to any substance, material, or composition that exhibits at least some degree of flame retardant properties. In selected embodiments, such a flame retardant may help impart fire resistance to a protector as disclosed herein. In selected embodiments, little or no flame retardant additive may be required. In other embodiments, such as those relating to paper and polymer-based protectors, fire retardant materials such as those described, for example, in "Fire Retardant Materials", by Dennis Price and A. Richard Horrocks, CRC, Woodhead Publishing Limited, February 2001 may be utilized. Such families of flame retardant materials may include but are not limited to halogen-based compounds (e.g.: brominated compounds such as PBDE, and PBB), phosphorus based compounds (e.g.: ammonium phosphate), borates, metal hydroxides (e.g.: aluminum hydroxide) and other hydrated inorganic additives (e.g.: plaster). Flame retardant materials can also be added to the silicone rubber to improve its heat resistant properties, such as those available from the Dow Chemical Company and other suppliers. Numerous silicone rubber compositions that include flame retardant additives are known in the art. U.S. Pat. Nos. 4,310,444 issued Jan. 12, 1982, 4,366,278 issued Dec. 28, 1982, and 4,678,827 issued Jul. 7, 1987, are just a few examples of references disclosing such compositions and flame retardant additives. Further flame retardant additives that are known in the art may be used with a protector as disclosed herein. A skilled artisan may select a flame retardant additive that is suitable for use with a protector material or composition.

Protector: refers to a device of the present invention as described herein that substantially covers an explosive end of a detonator, and optionally additional portions of a detonator, and helps to prevent movement away from the explosive end of shrapnel and/or explosive energy upon actuation of a base charge located at or near the explosive end. The term "protector" may, at least in selected embodiments, be interchangeable with the term "cap".

Shrapnel: refers to any fragments or debris thrown out by any exploding object, more particularly from an explosive end of a detonator upon actuation of a base charge located at or near the explosive end.

DETAILED DESCRIPTION OF THE PREFERRED EMBODIMENTS

The present invention provides, at least in preferred embodiments, for protectors, protected detonator assemblies, and methods for the storage and transport of detonators, preferably to achieve 1.4 packaging requirements in accordance with UN Recommendations. A protector or "cap" is used to cover at least the explosive end of a detonator shell while the rest of the detonator may be left at least substantially uncovered by the cap. Preferably, the protective cap is made of material resistant to high temperature and flame, which means having the property to at least substantially maintain its shape and cohesion upon actuation of a nearby base charge, or exposure to high temperatures or flames. More preferably, the cap may comprise a resiliently deformable material, for reasons that will become apparent below. For example, any polymers, plastics, elastomers, vinyls, rubbers, having that property can be used. (An agent that is not merely fireproof, but which calcines upon burning or concretes upon heating, may be less suitable for this invention since it may provide less protection for the detonator when burnt.) In preferred embodiments, the material also has a certain degree of malleability and/or elasticity to fit on the explosive end and stay in place. Preferably, the material used is a cross-linked polymer, and more preferably silicone rubber. In other embodiments, the protector may comprise less resilient materials such as resins and plasters, or wood-derived products. In a most preferred embodiment, the material further comprises a flame retardant additive.

The present invention has been developed by virtue of multiple discoveries by the inventors, which in combination provide optimal results to achieve the advantages outlined above. One discovery relates to the need for maintaining a sufficient mass of explosive energy-absorbing material generally or immediately adjacent the explosive end of a detonator. The inventors have discovered that a mass, specifically located adjacent the explosive end of the detonator, helps to impede the acceleration of shrapnel derived from the explosive end upon actuation of the base charge, and thus limits the final velocity and the inertia of the shrapnel. In this way, the protector contains the shrapnel created when the detonator explodes. This is achieved by designing the detonator protector in such a way that a portion of its mass is located at the axial end of the explosive end, preferably in direct contact with the detonator, so that it effectively "catches" the shrapnel when the base charge is actuated.

In preferred embodiments, the detonator protector comprises a resiliently deformable material that is able to form a tight fit around the explosive end of the detonator. Resiliently deformable materials are particularly preferred, since they may better assist in deceleration of shrapnel material being ejected or emanating from the explosive end, thereby reducing the inertia of the shrapnel. Moreover, the preferred tight fit of the detonator protector, by virtue of the resilient deformability of the detonator protector material, results in a tightly sealed interface leaving little or no gap between the detonator protector and the explosive end. In this way, any shrapnel will have neither time nor space to accelerate prior to encountering the detonator protector, further contributing to the advantages of the device. Moreover, a tight fit reduces the possibility of the protector being removed from the detonator before, during, or after actuation of the base charge, so that its protective function is maintained.

The protectors herein are not, however, limited only to those that stay in place by interference or friction fit. A protector may be held on an explosive end of a detonator by any means, including for example, screw-thread fitting, snap-fitting, or any other form of suitable engagement, optionally assisted by friction fitting such as that provided by the use of resilient materials.

Another important discovery by the inventors relates to the need for the protector, at least in preferred embodiments, to allow the detonator (to which it is attached) to burn or "cook off" in as full and complete a manner as possible, in the event of inadvertent detonator actuation. Indeed, failure of detonators to "cook off" sufficiently during a standard UN Test Series 6 external fire test (Bonfire test), can result in an unacceptable quantity of unburned explosive material remaining within the detonators after the test is complete. The inventors have discovered that by protecting principally the explosive end of the detonator, whilst leaving other portions of the detonator at least substantially unprotected by protector materials, improved detonator "cook-off" is achievable, even when the protectors of the invention remain attached to detonators during the testing procedures. In this way, the portions of the detonator shell not covered by a protector permit the heat of a test fire to be conducted more efficiently to the explosive material in the base charge at the explosive end of the detonator, thereby allowing it to burn or cook off more rapidly and/or efficiently. A more rapid cook-off also helps to reduce burning or other consuming of the protector material by the fire, so that a sufficient mass of the protector can be retained at the explosive end, for sufficient time for the protector to provide the required protective function. Preferably, the protector is designed to stretch onto and to fit tightly upon the explosive end of the detonator, so that it can maintain its position and its protective function throughout all the packaging, storing, and transporting procedures. This may be facilitated by selecting an appropriate material as discussed above.

When packaging multiple detonators, it is preferred to favour alternate "head-to-tail" orientation of adjacent detonators in the package. This helps to maintain at least a limited distance between the percussion-actuation ends of adjacent detonators within the package. With this arrangement there is a reduced possibility that inadvertent actuation of the base charge of one detonator may be directed to cause actuation of the base charge of a second detonator. Therefore, propagation to further detonators is less unlikely. The present invention therefore further provides for a method of packaging multiple detonators by protecting each detonator with the protector of the invention, and positioning each detonator in an alternating pattern, the explosive end of a first detonator facing one side of the package as the explosive end of its adjacent protected detonator is facing the opposite side of the package and so on, thereby to form a row of alternately oriented detonators. If required, multiple rows of alternately oriented detonators may be stacked so that the detonators within one row are oriented in an opposite, alternating manner to detonators in a row stacked immediately above or below. Multiple rows may also be present in a single layer of detonators. Most preferably, any space in between adjacent protected detonators in a row, and in between adjacent rows or stacked rows, may be filled with an energy-absorbing and/or isolating material. Such isolating material may comprise any suitable material including but not limited to paper products, resins, plastics and foams. Any kind of packaging material, suitable for transport and storage of detonators, may be used, preferably having a capacity to absorb explosive energy, as well as flame retard properties. Such materials may also be used to surround protected, stacked arrays of detonators, once packaged.

Copper alloy shelled detonators are known in the art to be more shock resistant than aluminum detonators. They are also known to project shrapnel at a longer distance and with a greater energy. Such shrapnel may be more penetrating, due in part to the fact that copper is a denser metal than aluminum. Copper has the property to have superior electrical and thermal conductivity than aluminum, and well as superior shock resistance. For those reasons, there is a trend in the explosive industry to favor copper detonators over aluminum ones. Preferably, the present invention permits safe packaging and transport of copper-shelled detonators in compliance with UN 1.4 standards.

The detonator protectors of the present invention may be comprised of any metal or non-metal material. Silicone rubber, wood, plastic, rubber, plaster, cement, cardboard, balsa wood, resin, or compressed sawdust are a few examples of suitable attenuator materials for the protectors. Silicone rubber and plaster have been demonstrated to exhibit particularly preferred properties. The testing by the inventors has enabled silicone detonator protectors to pass at least UN Test Series 6(d) testing to date, and corresponding plaster detonator protectors have passed 6(a), 6(c), and (6d) testing to date. Silicone rubber also represents a preferred material due to its resiliently deformable properties, that are particularly suited to tight securing of the protector onto the percussion-actuation end of a detonator. Plaster and silicone rubber, as well as other materials listed therein, are generally non-toxic and thus may present little environmental concern if discarded or otherwise not recovered from a blast site.

The invention thus provides, in selected embodiments, for both detonator assemblies (comprising a detonator in combination with a detonator protector as described herein), as well as for a detonator protector per se. The invention also provides for methods of protecting detonators involving the detonator protectors described herein, as well as methods for packaging detonators so as to improve the safety of the finished package.

Certain exemplary embodiments thus provide for an assembly comprising:

(a) a detonator comprising a detonator shell, and an explosive end comprising a base charge of explosive material;

(b) a detonator protector comprising a recess for receiving and covering the explosive end of the detonator shell and having a mass sufficient to contain shrapnel and/or explosive energy derived from the detonator in the event of inadvertent actuation of the base charge, said detonator protector being dimensioned such that most of the detonator shell is not covered by the protector, thereby to allow the explosive material of said base charge to deflagrate in the event of inadvertent actuation of the detonator and/or exposure of the assembly to the heat of a fire. As discussed above, such a detonator assembly exhibits the desired attributes of excellent containment of shrapnel and/or explosive energy in the event of inadvertent actuation of the detonator, combined with rapid and/or efficient cook-off of the explosive material of the base charge.

Preferably, the detonator protector is made of a material having a resilience to maintain its shape and cohesion upon exposure to a high temperature, a flame, or upon actuation of a base charge located in said explosive end. In particularly preferred embodiments the material may be selected from any cross-linked polymer or silicone rubber, and may optionally further comprise any flame retardant as an additive. Such substances and additives are well known in the art. Silicone-based materials are particularly preferred, since they provide excellent cohesion, flame-retardancy, and resiliently deformable properties. In further exemplary embodiments, the protector may comprise a polymer that in the event of exposure to fire is capable of conversion to a ceramic-type material. Such polymers are known in the art such as those manufacture and/or utilized in Pyrolex® Ceramifiable® cables manufactured by Olex Cables of Tottenham, VIC, Australia, Regardless of the material, the detonator protector is preferably comprised of a resiliently deformable material to facilitate placement or securing of the protector onto the explosive end of the detonator, and to help achieve a tight fit and secure grip by the detonator protector on the explosive end, thereby to keep the protector in place during transportation, storage, or detonator actuation. Furthermore, dimensioning of the detonator protector is preferably such that it covers less than one-third of a length of the detonator from the explosive end. As discussed above, by leaving most of the detonator shell exposed, this improves the speed or efficiency of cook-off the detonators for example by virtue of improved heat conductance to the base charge. This helps to reduce the possibility of explosive materials remaining in the detonator following inadvertent actuation thereof.

In selected embodiments, a detonator assembly of the invention may comprise more than one detonator associated with a detonator protector. For example, the assembly may comprise two detonators each with their explosive ends contained within each of two recesses in a detonator protector. In preferred embodiments, such a protector may be configured so that insertion of the explosive ends of both detonators causes the detonators to attain an opposing, aligned orientation, with their respective explosive ends separated by a portion of the detonator protector. The portion of the detonator protector between opposing explosive ends of the detonators may be perforatable by shrapnel and or explosive energy emitted upon inadvertent actuation of one of the detonators, such that said inadvertent actuation causes cook-off of a base charge in the other of said detonators, said detonator protector substantially containing shrapnel from one or both of said detonators. In other related embodiments, the protector may not include any material between the opposing ends of the detonators, so that the protector is effectively in the form of a tube of material, with each open end of the tube being dimensioned to receive an explosive end of a detonator.

Other exemplary embodiments pertain to a detonator protector per se, for covering at least an explosive end of a detonator to contain shrapnel and/or explosive energy derived from the detonator in the event of inadvertent actuation of a base charge contained within the explosive end. The detonator protector may be dimensioned such that in use most of the detonator shell is not covered by the protector, thereby to allow the explosive material of said base charge to at least substantially deflagrate in the event of inadvertent actuation of the detonator. The preferred properties and features of a detonator protector of the invention are described herein with reference to a detonator assembly.

Still further exemplary embodiments pertain to methods of protecting a detonator from emitting shrapnel and/or explosive energy during transportation and/or storage. Such methods may comprise the step of: applying to an explosive end of the detonator, a detonator protector as described herein.

Still further exemplary embodiments pertain to methods of packaging a plurality of detonators each comprising a detonator shell and an explosive end comprising a base charge. Such methods comprise the steps of: applying to each explosive end a detonator protector as described herein; and placing the protected detonators into a container. Preferably, the step of placing comprises: disposing each protected detonator within a container according to an alternating pattern, wherein when a protected detonator has its protected explosive end facing one side of the package, each adjacent detonator having its protected, explosive end facing a side opposite said one side thereby to form a row of protected detonators. The step of placing may additionally or alternatively involve placing more than one row of detonators into the container, with explosive ends of at least one pair of adjacent detonators from adjacent rows facing generally into the package in aligned opposition, and disposed explosive end to explosive end, each pair of detonators protected by a detonator protector comprising two recesses for simultaneously receiving each explosive end of said pair, to hold the detonators in said aligned opposition, with their respective explosive ends separated by a portion of said detonator protector. The step of placing may also comprise placing multiple rows of protected detonators into the container, stacked one top of another, wherein adjacent rows of protected detonators and/or multiple rows of protected detonators stacked one on top of another, are preferably separated by a flame-retardant material.

Figure 1B:
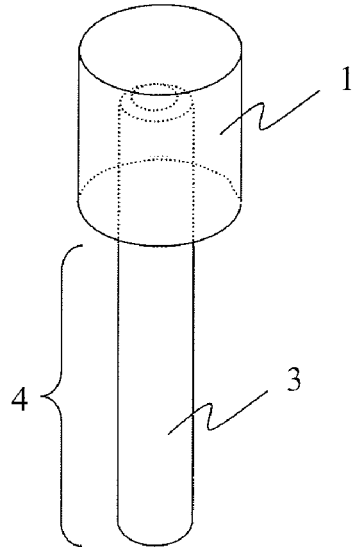
FIG. 1*b* is a perspective view of the assembly shown in FIG. 1*a*.

For the purposes of still further clarification of the invention, specific preferred embodiments of the invention will now be described with reference to the appended drawings, which are in no way intended to be limiting. FIG. 1*a* illustrates a detonator assembly of the invention, which comprises a detonator protector 1 of the invention shown in section, which generally covers the explosive end 2 (comprising a base charge) of the detonator 3 by way of recess 6 in detonator protector 1, leaving the rest of the detonator uncovered 4. The Figure also illustrates that a portion 1*a* of the mass of the protector is located in an axial position or otherwise adjacent the explosive end of the detonator to "catch" or otherwise contain shrapnel from actuation of the base charge. FIG. 1*b* illustrates the assembly shown in FIG. 1*a*, in perspective view.

It should be noted that although the protector illustrated in FIG. 1*a* (and the following figures) is generally rectangular in section, the protector may have any shape or size, providing that it is adapted for catching or otherwise containing shrapnel, and preferably fitting securely upon the detonator. Also for purpose of clarity, the figures may illustrate a gap between the protector and the detonator surfaces. However, this is merely for illustrating the components present and is in no way intended to be limiting. Any such gap may be small or absent, as long as the functions of the detonator protector are maintained.

Figure 2:
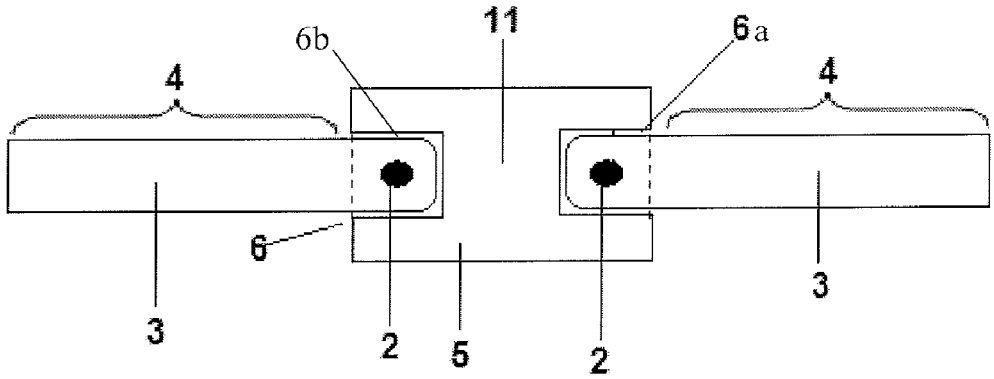
FIG. 2 is a sectional view of a preferred double-protecting device of the present invention

FIG. 2 illustrates a "double" protector 5 of the invention in section, which is designed to protect two detonators at the same time. Detonator protector 5 has two recesses 6*a* and 6*b* at opposite ends to cover explosive ends of two different detonators. It may be noted that part 11 between the explosive ends of the detonators as represented in FIG. 2 is in no way intended to be limiting. This part can be absent, thin or otherwise perforatable by shrapnel and/or explosive energy derived from a detonator being protected by the protector, thereby to cause the second detonator to at least substantially cook off in the event the first one accidentally explodes.

FIG. 3 illustrates a package of detonator assemblies generated according to a packaging method of the present invention. FIGS. 3*a* and 3*b* illustrate a plurality of detonators oriented according to an alternating pattern. Each detonator 3 is protected by a detonator protector 1 (each shown in section). Each detonator assembly is disposed according to an alternating pattern from adjacent detonator assemblies in a row of detonator assemblies. In FIG. 3*a*, the first detonator assembly 30 has its protected end 7 facing side 8 of package 20, the adjacent detonator assembly 31 has its protected end 7 facing the opposite side 9 of package 20, the third detonator assembly 32 has its protected end facing side 8. This pattern may be repeated to generate several rows of detonator assemblies in the package.

Figure 3A:
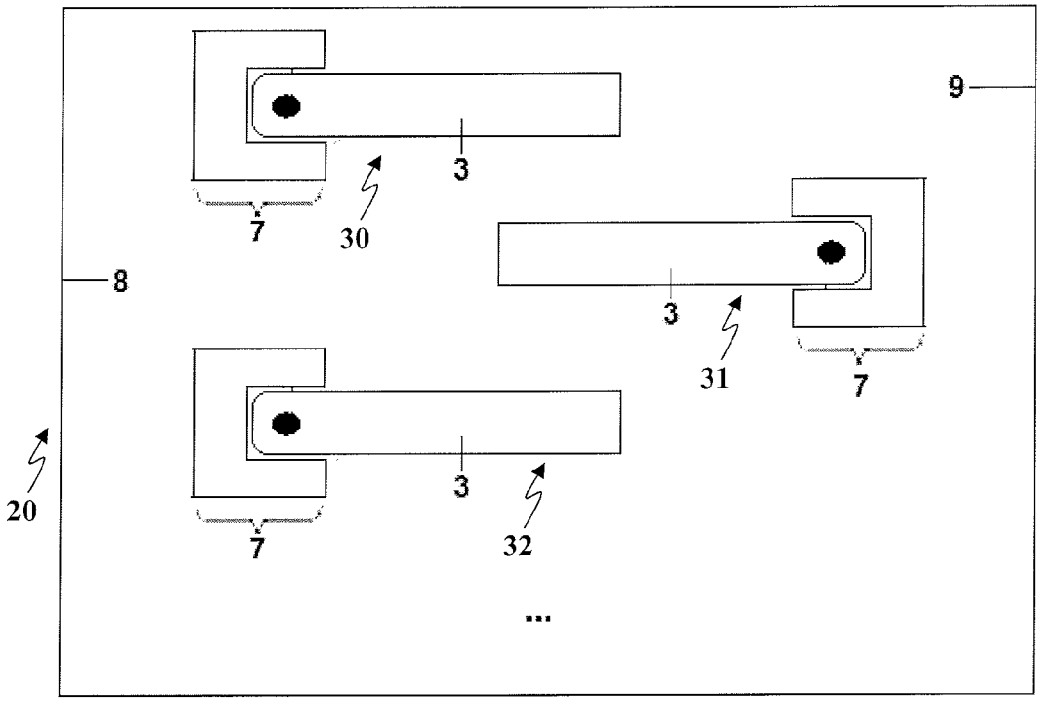
FIG. 3*a* is a sectional view of a preferred alternate packaging
Figure 3B:
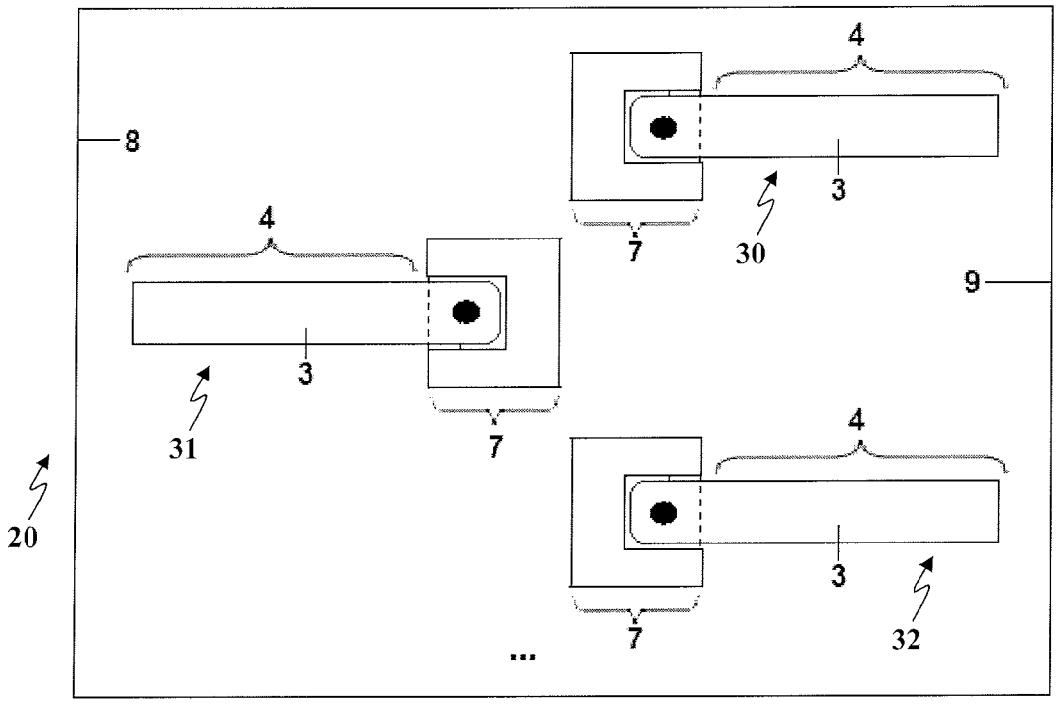
FIG. 3*b* is a sectional view of another preferred alternate packaging

Another option for an alternate packaging is illustrated in FIG. 3*b*. The first detonator assembly 30 has its protected end 7 facing generally into package 20, so that its uncovered part 4 is facing the side 9 of the package. The adjacent detonator assembly 32 also has its protected end 7 facing generally into the package but with its uncovered part 4 facing opposite side 8.

Figure 3C:
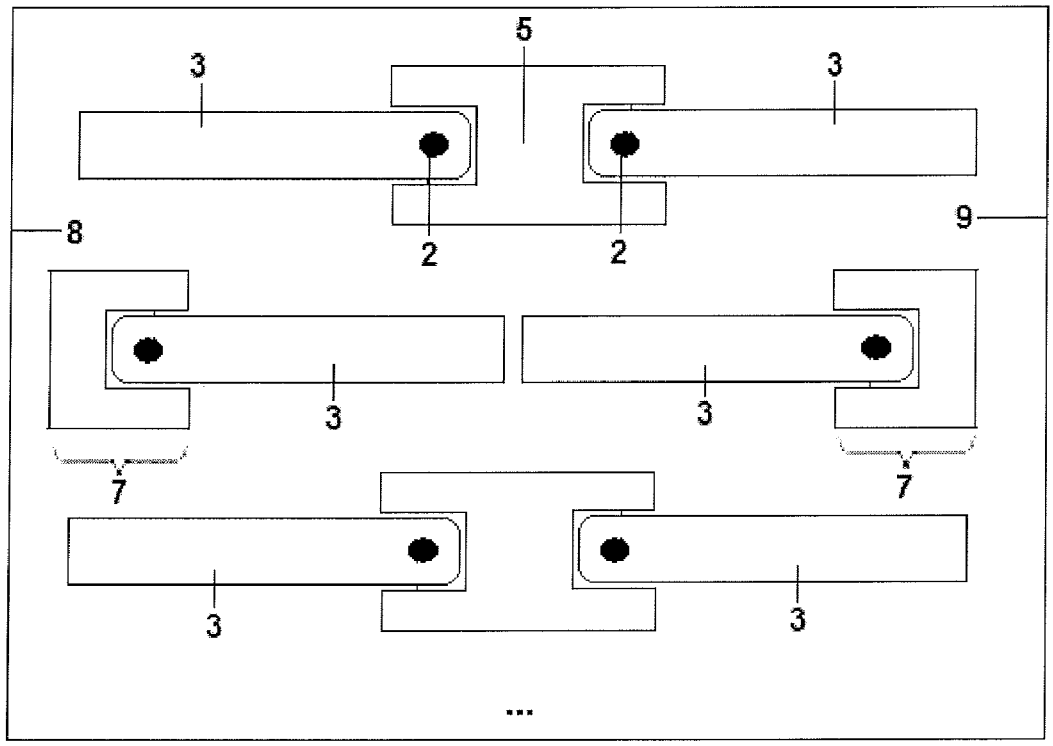
FIG. 3*c* is a sectional view of another preferred alternate packaging

FIG. 3*c* illustrates an alternative packaging arrangement wherein pairs of detonators 3 are side-by-side, but the pairs of detonator assemblies are also packaged in an alternating pattern. When two detonators of a pair have their explosive ends 2 facing generally into the package in alignment, disposed explosive end 2 to explosive end 2, the two detonators can be protected by a double protector 5 shown in FIG. 2. The other pair adjacent detonator assemblies each have their protected ends 7 facing sides 8 and 9 of the package according to an alternating pattern.

Figure 3D:
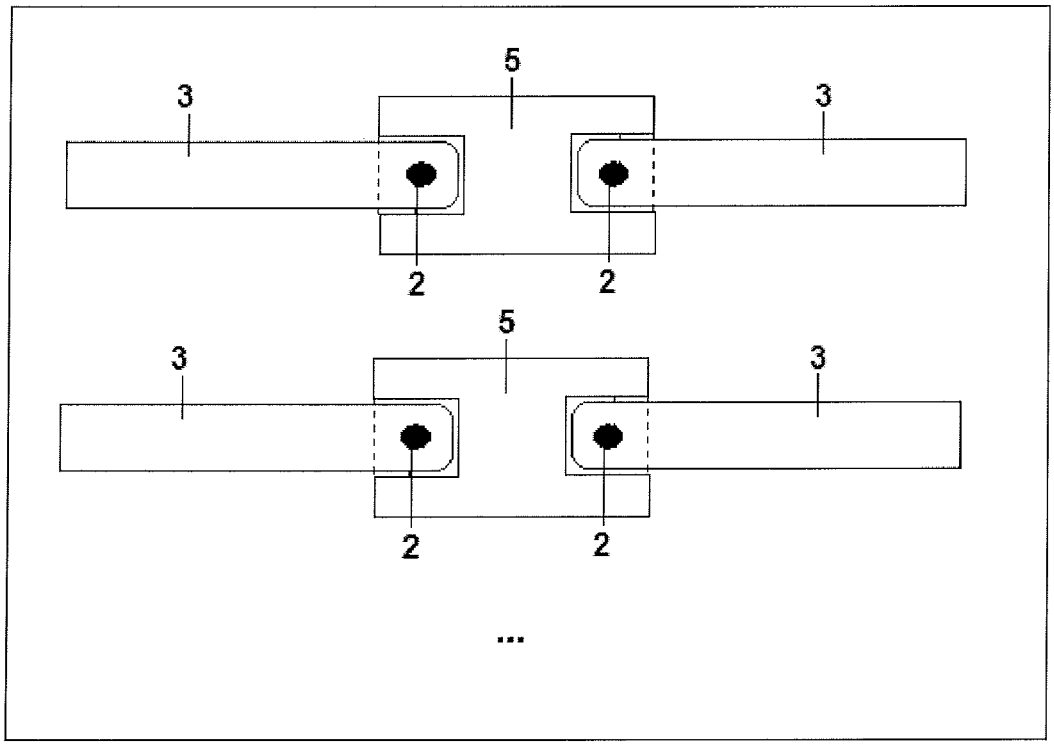
FIG. 3*d* is a sectional view of another preferred packaging
Figure 3C:
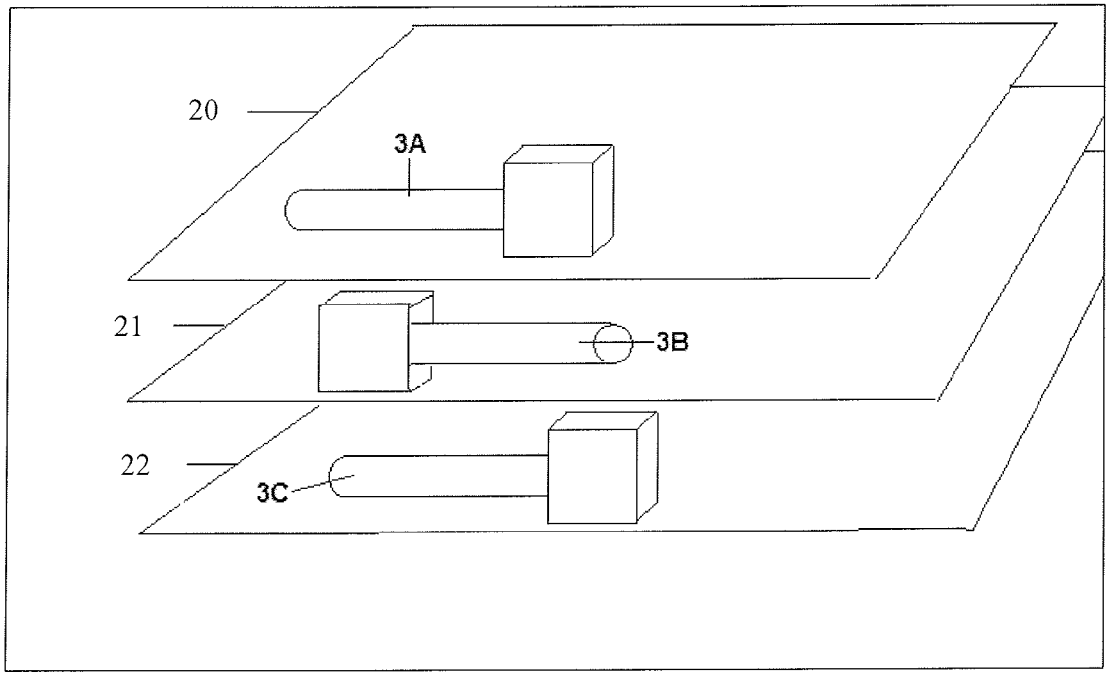

FIG. 3*d* shows a package comprising pairs of detonator assemblies 3 each being disposed explosive end 2 to explosive end 2 and protected by a double cap 5 as shown in FIG. 2.

FIG. 3*e* illustrates how rows of detonator assemblies may be stacked within a container, one row on top of another, so that each row has opposite orientation of detonator assemblies compared to a row immediately thereabove or therebelow, i.e. the first detonator assembly 3A of a row 20 is in an opposite position compared to the first detonator 3B of row 21 beneath row 20, and that the first detonator assembly 3C of row 22 is in the same orientation as detonator assembly 3A. For convenience and ease of illustration, only the first detonator assemblies 3A, 3B, and 3C are shown in rows 20, 21, and 22. Additional detonator assemblies may be present in each row in alternating orientation as previous discussed.

While the invention has been described with reference to particular preferred embodiments thereof, it will be apparent to those skilled in the art upon a reading and understanding of the foregoing that numerous detonator protectors, corresponding detonator/protector assemblies, and methods for transportation and storage of detonators, other than the specific embodiments illustrated are attainable, which nonetheless lie within the spirit and scope of the present invention, It is intended to include all such methods, systems, and equivalents therefore within the scope of the appended claims.

The invention claimed is:

1. An assembly comprising:

(a) a detonator comprising a detonator shell having an explosive end, and a base charge of explosive material at the explosive end;

(b) a detonator protector comprising a recess for receiving and covering at least the explosive end of the detonator shell to contain shrapnel and/or explosive energy derived from the detonator in the event of inadvertent actuation of the base charge, said detonator protector being dimensioned such that it covers less than one-third of a length of the detonator shell from the explosive end, thereby to allow the explosive material of said base charge to deflagrate in the event of inadvertent actuation of the detonator and/or exposure of the assembly to the heat of a fire; wherein the detonator and detonator protector are held together by a friction fit when the at least the explosive end of the detonator shell is received in the recess and covered by the detonator protector, said detonator protector being made of a resilient material resiliently deformable to facilitate receipt of the at least the explosive end of the detonator shell in the recess and to facilitate tight fitting and gripping of the detonator protector on the at least the explosive end of the detonator shell to keep the detonator protector in place during transportation or storage of the assembly, or inadvertent actuation of the detonator.

2. The assembly of claim 1, wherein the detonator protector comprises a material selected from a cross-linked polymer, a plaster, a ceramifiable polymer, or a silicone rubber, any of which may optionally further comprise a flame retardant.

* * * * *